US008482202B2

(12) United States Patent
Deng

(10) Patent No.: US 8,482,202 B2
(45) Date of Patent: Jul. 9, 2013

(54) THALLIUM IODIDE-FREE CERAMIC METAL HALIDE LAMP

(75) Inventor: Lei Deng, Cleveland, OH (US)

(73) Assignee: General Electric Company, Schenectady, NY (US)

( * ) Notice: Subject to any disclaimer, the term of this patent is extended or adjusted under 35 U.S.C. 154(b) by 87 days.

(21) Appl. No.: 12/877,637

(22) Filed: Sep. 8, 2010

(65) Prior Publication Data

US 2012/0056534 A1 Mar. 8, 2012

(51) Int. Cl.
*H01J 17/20* (2006.01)
*H01J 61/20* (2006.01)

(52) U.S. Cl.
USPC ..... 313/640; 313/637; 313/639; 313/641

(58) Field of Classification Search
USPC ..... 313/567, 637–643, 483–484, 623–625, 313/570
See application file for complete search history.

(56) References Cited

U.S. PATENT DOCUMENTS

| | | | | |
|---|---|---|---|---|
| 4,801,846 | A | 1/1989 | Kramer et al. | |
| 5,239,232 | A | 8/1993 | Heider et al. | |
| 6,501,220 | B1 | 12/2002 | Lambrechts et al. | |
| 6,717,364 | B1 | 4/2004 | Zhu et al. | |
| 6,819,050 | B1 | 11/2004 | Zhu et al. | |
| 6,979,958 | B2 | 12/2005 | Zhu et al. | |
| 7,012,375 | B2 | 3/2006 | Brock | |
| 7,138,766 | B2 | 11/2006 | Takeuchi et al. | |
| 7,256,546 | B2 | 8/2007 | Brock et al. | |
| 7,423,380 | B2 | 9/2008 | Ota et al. | |
| 2005/0212436 | A1 | 9/2005 | Brock | |
| 2006/0164017 | A1 * | 7/2006 | Rintamaki et al. | 313/640 |
| 2009/0146576 | A1 * | 6/2009 | Russell et al. | 315/248 |
| 2010/0006165 | A1 | 1/2010 | Banta et al. | |
| 2010/0013417 | A1 * | 1/2010 | Ramaiah et al. | 315/358 |
| 2011/0031879 | A1 * | 2/2011 | Russell et al. | 313/638 |
| 2011/0031880 | A1 * | 2/2011 | Russell et al. | 313/643 |

FOREIGN PATENT DOCUMENTS

WO WO 2008/139486 A2 10/2008

OTHER PUBLICATIONS

EP 11 17 8783.4 (corresponding application) European Search Report mailed Aug. 21, 2012.

* cited by examiner

*Primary Examiner* — Anne Hines
*Assistant Examiner* — Jose M Diaz
(74) *Attorney, Agent, or Firm* — Fay Sharpe LLP

(57) ABSTRACT

The present disclosure relates to a discharge lamp able to be operated at less than full rated power without suffering undesirable color shift, loss of lumen maintenance or loss of lamp efficacy. It finds particular application in connection with ceramic metal halide lamps having no thallium iodide in the dose thereof.

17 Claims, 4 Drawing Sheets

THALLIUM IODIDE-FREE CERAMIC METAL HALIDE LAMP

BACKGROUND OF THE DISCLOSURE

The present disclosure relates to a discharge lamp able to be operated at less than full rated power exhibiting excellent lumen maintenance and high luminous efficacy without suffering undesirable color shift. It finds particular application in connection with ceramic metal halide lamps having no thallium iodide in the dose thereof, and will be described with particular reference thereto.

High Intensity Discharge (HID) lamps are high-efficiency lamps that can generate large amounts of light from a relatively small source. These lamps are widely used in many applications, including retail display lighting, highway and road lighting, lighting of large venues such as sports stadiums, floodlighting of industrial and commercial buildings and shops, and projectors, to name but a few. The term "HID lamp" is used to denote different kinds of lamps. These include mercury vapor lamps, metal halide lamps, and sodium lamps. Metal halide lamps, in particular, are widely used in areas that require a high level of brightness at relatively low cost. HID lamps differ from other lamps because their functioning environment requires operation at high temperature and high pressure over a prolonged period of time. Also, due to their usage and cost, it is desirable that these HID lamps have relatively long useful lives and produce a consistent level of brightness and color of light. Although in principle HID lamps can operate with either an alternating current (AC) supply or a direct-current (DC) supply, in practice, the lamps are usually driven via an AC supply.

Discharge lamps produce light by ionizing a vapor fill material, such as a mixture of rare gases, metal halides and mercury, with an electric arc passing between two electrodes. The electrodes and the fill materials are sealed within a translucent or transparent discharge vessel that maintains the pressure of the energized fill materials and allows the emitted light to pass through it. The fill materials, also known as the lamp "dose," emit a desired spectral energy distribution in response to being excited by the electric arc. For example, halides provide spectral energy distributions that offer a broad choice of light properties, e.g. color temperatures, color renderings, and luminous efficacies.

Given current awareness in society surrounding the use of energy in a more efficient and economical manner, there is an increasing interest in the lighting industry in ways to reduce energy consumption, optimally without sacrificing lamp performance. One solution would be to operate lamps at a reduced power level. The potential savings in energy consumption for commercial lighting purposes, as well as the opportunity to reduce consumption of our energy resources as a society, are substantial.

At least one drawback exists, however, in operating Ceramic Metal Halide (CMH) lamp lighting at less than its full power rating. As the operating lamp power level is reduced, the color of emitted light shifts from white to green, correlating to an increase in the correlated color temperature (CCT) of the lamp by as much as 1000° K or more. CMH lamp color is primarily decided by the halide dose composition in the vapor phase in the arc tube. A typical CMH lamp, for example, contains NaI, TlI, CaI2 and some rare earth iodides such as DyI3, HoI3, TmI3, CeI3 or LaI3. When the CMH lamp is dimmed, the halide vapor pressure in the arc will drop with the reduction of arc tube temperature. In addition, the TlI vapor pressure drops more slowly than that of the rare earth halides. Because the TlI emits green light, and remains at a relatively higher vapor pressure that the remaining iodides, the lamps experience a color shift from white to green at dimmed conditions. Such a shift in light color has a considerable impact on commercial usage. For example, retail and display venues, which often employ CMH lamps due to their long life and focused light emissions, can suffer considerably from lighting that does not present items being displayed to their best advantage, i.e., under white light. The same is true for public venues where lighting contributes to the atmosphere or ambiance experienced by customers.

With current technology, lamp chemistries provide very beneficial properties on most performance metrics. However, when lamps are operated at reduced power to reduce energy consumption, these performance metrics may be altered, and specifically the color of the emitted light may be negatively affected. Attempts have been made to reduce the undesirable color shift that occurs when operating a lamp at less than 100% of its power rating by altering dose chemistry, but often these attempts have resulted in lamps suffering from reduced efficacy and over-all lumen loss. These parameters relate directly to the color of light emitted by the lamp, and therefore directly affect the satisfaction of the consumer using the lamp. Efforts aimed at solving emission color problems by changing the lamp dose, however, have resulted in losses, and sometimes substantial losses, with regard to other performance and photometric parameters, even when the change in dose chemistry has been minimal. Therefore, in some instances efforts to improve lamp color have done so at the expense of other important lamp parameters.

For example, U.S. Pat. No. 6,501,220, U.S. Pat. No. 6,717,364 and U.S. Pat. No. 7,012,375, disclose the inclusion of DyI3, TmI3 or HoI3 in the lamp dose, which are known to interrupt the tungsten halogen cycle in the CMH lamps. As a result, these lamps have poor lumen maintenance. In addition, some of the above patents contain MgI2, which may prove beneficial with regard to dimming characteristics, but also cause reductions in lamp efficacy and lumen maintenance. So far, there is lacking a CMH lamp dose that can provide excellent dimming characteristics and at the same time provide good lumen maintenance and efficacy. The foregoing drawbacks have been a limiting factor to the widespread use of CMH lamps under dimming, energy saving conditions.

There exists, therefore, a need to be able to satisfy the need to operate lighting, regardless of the setting, in a more energy efficient manner, and at the same time to be able to do so without suffering a loss of the perceived white color of the emitted light, particularly without causing a shift toward a more green hue of emitted light, without reducing lumen maintenance, and without detracting from lamp efficacy. What is desired is a lamp capable of operating, at the consumer's choice, at a reduced power rating, up to as much as 50% less power, while maintaining a white light emission, good lumen maintenance and efficacy of the lamp.

Unexpectedly, the present invention achieves all of the foregoing desirable parameters, while causing no or only negligible losses in other performance and photometric parameters of the lamp. This is accomplished by employing a lamp dose devoid of thallium iodide together with an optimization of other halides compositions. The result is a lamp exhibiting excellent performance with regard to lumens, efficacy, and light color.

SUMMARY OF THE DISCLOSURE

In an exemplary embodiment, a lamp includes a discharge vessel having sealed therein an ionizable fill including at least an inert gas, mercury, and a halide component having no thallium present therein, the halide component including an alkali metal halide, an alkaline earth metal halide, and a rare earth halide. For example, the halide component, devoid of any thallium halide, may include sodium halide, at least one of calcium or strontium halide, and at least one of cerium or lanthanum halide, and may further optionally include cesium halide or indium halide.

In yet another embodiment of the invention, a method of forming a lamp is provided. The method includes providing a discharge vessel having sealed therein an ionizing fill, this fill including an inert gas, mercury, an alkali metal halide, an alkaline earth metal halide, and a rare earth halide including at least one of La or Ce. The halide component, for example, may include a sodium halide, at least one of a calcium halide and strontium halide, and at least one of a rare earth halide selected from the group consisting of lanthanum and cerium, and optionally cesium halide or indium halide. The method further includes positioning electrodes within the discharge vessel to energize the fill in response to a voltage applied thereto. It will be appreciated that the current invention is not limited to any particular manufacturing method or processing.

A primary benefit realized by the lamp according to an embodiment of the invention is enhanced color of emitted light when the lamp is operated at less than the full power rating of the lamp, typically at a reduction of about 50% of full rated power, with no perceivable color shift, primarily due to the exclusion of thallium iodide from the lamp dose.

Another benefit realized by the lamp according to an embodiment of the invention is enhanced lumen maintenance of 15% or greater after 3000 hours of operation over prior art CMH lamps.

Yet another benefit realized by the lamp according to an embodiment of the invention is enhanced efficacy, in excess of 90 LPW.

Other features and benefits of the lamp according to the invention will become more apparent from reading and understanding the following detailed description.

DETAILED DESCRIPTION OF THE PREFERRED EMBODIMENTS

Figure 1:
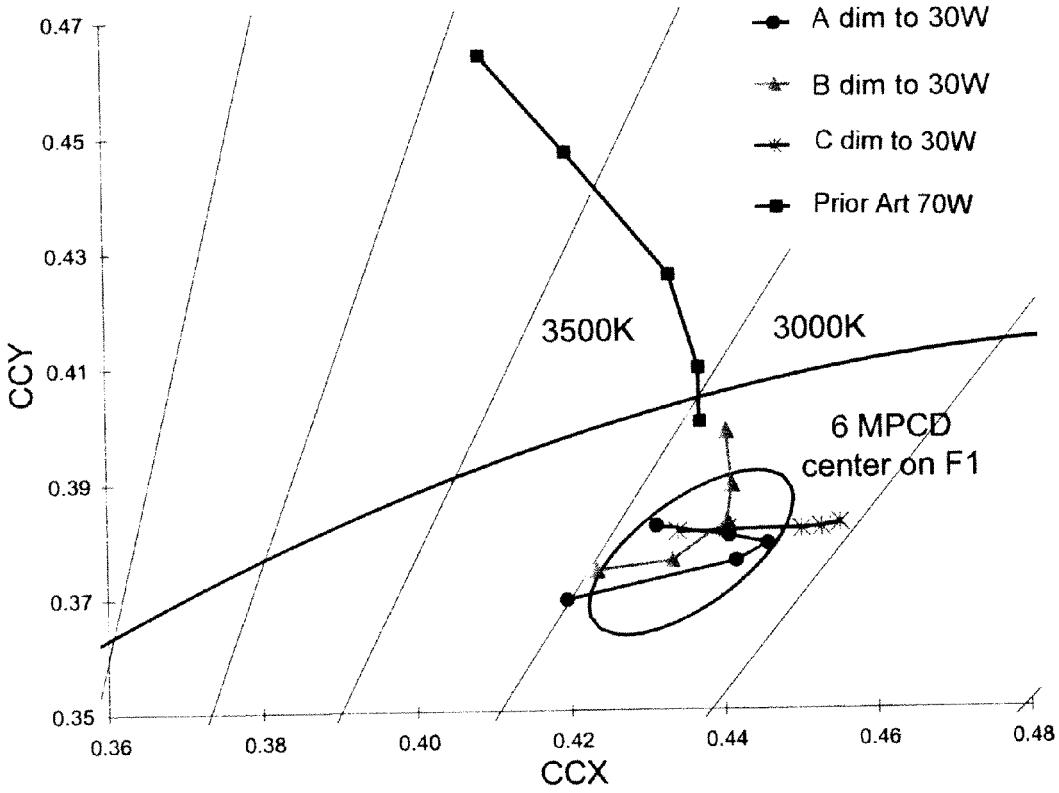
FIG. 1 is a graph showing the shift in color point within 6 MPCD for lamps in accord with an embodiment of the invention as compared to the shill in color point for a comparable, conventional.

The present disclosure relates to a discharge lamp able to be operated at less than full rated power without suffering undesirable color shift, loss of lumen maintenance or loss of lamp efficacy. It finds particular application in connection with ceramic metal halide lamps including a dose containing no thallium halide and at least one of lanthanum or cerium halide, wherein the lamp when operated at less than its nominal lamp power exhibits substantially no color shift, good lumen maintenance and good efficacy. In an exemplary embodiment, a lamp includes a discharge vessel having sealed therein an ionizable fill including at least an inert gas, free mercury, and a halide component having no thallium included therein, the halide component including an alkali metal halide, an alkaline earth metal halide, and a rare earth halide including at least one of lanthanum and/or cerium. For example, the halide component, devoid of any thallium halide, may include sodium halide, at least one of calcium or strontium halide, and at least one of cerium or lanthanum halide, and may further optionally include cesium halide or indium halide.

In one embodiment there is provided a discharge lamp in accord with the foregoing that exhibits lumens per watt (LPW) of at least about 90, and preferably as high as 97, and further exhibits lumen maintenance of greater than about 90%, i.e. about 93%, after 3000 hours of operation. The lamp CCT shifts less than +/−200K when operated at a reduced power level, as low as about 50% of the rated lamp power. As used herein, the term "rated power", "nominal lamp power" and "lamp power rating", or any version thereof, which may be used interchangeably herein, refers to the optimum wattage at which the lamp is intended to be operated, in accord with industry standards. In this regard, for example, incandescent lamps may be marketed as 100 W, 70 W or 50 W lamps, the watts (W) indicating the full power rating of the lamp. Likewise, HID lamps may commonly be marketed as 150 W, 100 W, 70 W, 50 W, 39 W and 20 W lamps.

In another embodiment, there is provided a ceramic metal halide lamp which, when operated at less than 80% of its nominal lamp power, and even at less than about 50% of its nominal lamp power, i.e., 43% of its nominal lamp power, exhibits a CCT substantially the same as, or within about +/−100° K of, the CCT of the lamp if operated at 100% of its nominal lamp power. Therefore, due to the fact that the CCT remains substantially the same, the lamp emission does not undergo any noticeable color shift, i.e., the light emitted by the lamp is perceived as white light. In addition to the foregoing, the lamp in accord with at least one embodiment of the invention exhibits excellent lumen output and efficacy. The CMH lamp demonstrating these characteristics includes a dose which does not include thallium iodide, but which does include sodium halide, calcium or strontium halide, and at least one of cerium or lanthanum halide. As such, the following disclosure provides for a lamp having improved efficacy and better color performance than other comparable lamps currently available, even when such lamp is operated at less than its nominal lamp power.

As described in various aspects, the lamp is able to simultaneously satisfy photometric targets without compromising targeted reliability or lumen maintenance. Photometric properties that are desirable in a lamp design in accord herewith include lumens, CRI, CCT and Dccy.

The term "lumen" refers herein to the total amount of visible light emitted from a source, in this instance a CMH lamp. The efficacy of the lamp, or the luminous efficacy, is the ratio of luminous flux, in lumens, to power, usually measured in watts. Generally, in measuring the output of a source, or in measuring how well the source provides visible light from a given amount of electricity, the emission is measured in lumens per watt, LPW. Put another way, luminous efficacy represents the ratio between the total luminous flux emitted by a device (lumens) and the total amount of input power consumed by the device (watts). Some of the input energy is lost in the form of heat or other than visible light radiation.

Correlated color temperature (CCT) is defined as the absolute temperature, expressed in degrees Kelvin (K), of a black body radiator when the chromaticity (color) of the black body radiator most closely matches that of the light source. CCT may be estimated from the position of the chromatic coordinates (u, v) in the Commission Internationale de l'Eclairage (CIE) 1960 color space. From this standpoint, the CCT rating is an indication of how "warm" or "cool" the light source is. The higher the number, the cooler the lamp. The lower the number, the warmer the lamp. An exemplary lamp may provide a correlated color temperature (CCT) between for example, about 2700K and about 4500K, about 3300K and about 3200K, e.g., 3000K. For example, a CMH lamp having a conventional fill composition including NaI, $CaI_2$, TlI, and $LaI_3$, along with an inert gas and free Hg, may operate at a CCT of about 3000° K at its nominal lamp power of 70 W. This same lamp, however, when operated at a reduced lamp power, experiences an increase in CCT, such that when operated at about 50% of its nominal lamp power, the CCT is about 4400° K. This rise in CCT of approximately 1400° K corresponds to a color shift from white toward green. If, however, a lamp in accord with at least one embodiment hereof, having no thallium iodide in its dose composition, and including NaI, Cab or $SrI_2$, and at least one of $LaI_3$ and/or $CeI_3$, is similarly tested, at 100% of its nominal lamp power it exhibits a CCT of 3000° K and at 50% of its nominal lamp power it exhibits a CCT of only about 3100° K. This slight increase in CCT of about 100° K, from 3000° K to 3100° K, does not cause a color shift large enough to be perceived by most consumers. Therefore, the lamp in accord with the invention provides improved color quality of emitted light at reduced power, making the lamp an energy efficient lighting choice. The foregoing is merely exemplary and is provided merely to demonstrate how the subject lamp dose renders improved color quality. As such, it should be appreciated that the present invention is in no way limited to the specific embodiments described above, and various modifications thereof, including fills and temperatures, are contemplated herein.

Dccy is the difference in chromaticity of the color point on the Y axis (CCY), from that of the standard black body curve. With regard to FIG. 1, the black body curve, or locus, is shown as a solid black arc. Just below the arc, and positioned between about 0.42 and 0.45 on the X axis (CCX), there is shown what is commonly referred to as a MacAdam Ellipse. The term "MacAdam ellipse" refers to the region on a conventional chromaticity diagram, which contains all colors, which are indistinguishable, to the average human eye, from the color at the center of the ellipse. The ellipses were developed using matches made by independent observers of color points. MacAdam observed that all of the matches made by the observers fell into an ellipse on the CIE 1931 chromaticity diagram. The measurements were made at 25 points on the chromaticity diagram, and it was found that the size and orientation of the ellipses on the diagram varied widely depending on the test color. Using the MacAdam ellipses, it has been determined that color points for a single lamp, measured at different operating powers starting at 100% nominal lamp power, followed by reductions to 80%, 70%, 60% and 50%, must remain within an ellipse for the emitted color to be perceived as unchanging. Generally, it is understood that a difference in color points of more than 6 MPCD (minimum perceivable color difference) indicates a shift in the color of emitted light. FIG. 1 illustrates clearly that a conventional 70 W CMH lamp including TlI, as set forth above, does not generate color points falling within a single ellipse. In contrast, the three CMH lamps in accord with an embodiment hereof (labeled A, B and C, each having a dose in accord with Table, Example 1, not including TlI), each generated color points, at decreasing power, that fall within a single ellipse, i.e., exhibit an MPCD of 6 or less, and are thus deemed acceptable and as not representing a perceptible shift in the color of the emitted light.

Yet another commonly used color indicator is the color rendering index (CRI). CRI is an indication of a lamp's ability to show individual colors relative to a standard, and is derived from a comparison of the lamp's spectral distribution compared to that standard (typically a black body) at the same color temperature. There are fourteen special color rendering indices (Ri where i=1-14) which define the color rendering of a light source when used to illuminate standard color tiles. The general color rendering index (Ra) is the average of the first eight special color rendering indices (which correspond to non-saturated colors) expressed on a scale of 0-100. Unless otherwise indicated, color rendering is expressed herein in terms of the "Ra". The color rendering index of a conventional 70 W CMH lamp, having a fill comparable to that of a lamp in accord herewith, but including TlI may be in the range of about 80-88. As noted earlier, prior attempts to avoid a color shift in emitted light at reduced operating power have included reducing the amount of TlI. These attempts have resulted, however, in lamps exhibiting a CRI of well below 80. In contrast, the lamp having a dose devoid of thallium iodide and including the halide dose components as set forth herein has been shown to exhibit a CRI of as high as 86. It is understood in the industry that a CRI of anything greater than about 80 is considered excellent.

All of these ranges and parameters, i.e., consistent CCT of about 3000° K, MPCD of up to about 6, and CRI as high as 86, may be simultaneously satisfied by the present lamp design. Unexpectedly, this can be achieved without negatively impacting lamp efficacy and lumen maintenance. Thus, for example, the exemplary lamp may exhibit a CCT, CRI and color point correlating to improved color quality, i.e., white light emission, and yet maintain lumen efficacy and lamp life in accord with known, desirable standards, while operating at reduced nominal lamp power of less than 80%, and even as low as about 40%.

In one embodiment, a lamp including a discharge vessel and electrodes extending into the discharge vessel is provided. The lamp further includes an ionizable fill sealed within the vessel. The ionizable fill contains no thallium iodide. It has been realized herein that by not including thallium halide in the dose, and by further including halide dose components in accord with the following, the foregoing parameters relating to emission color can be advantageously achieved. The ionizable fill of this advantageous CMH lamp includes an inert gas, Hg, and a halide component including an alkali metal halide, at least one alkaline earth metal halide, and at least one of a rare earth halide selected from the group consisting of lanthanum and cerium.

Figure 2:
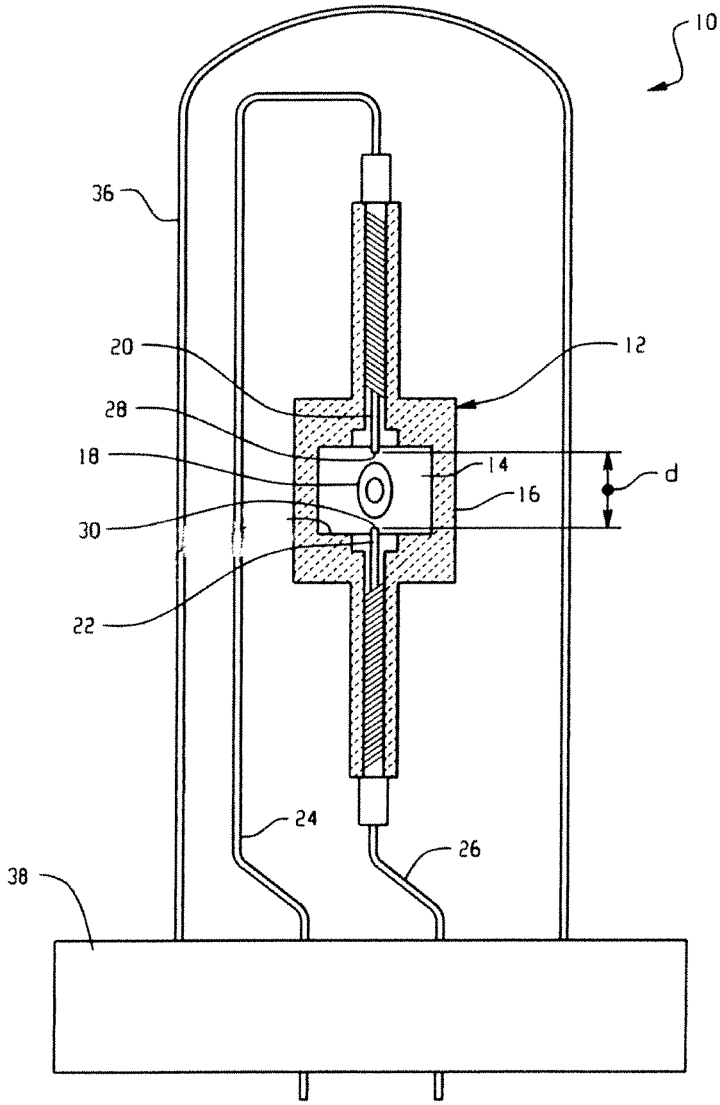
FIG. 2 lamp is a cross-sectional view of an HID lamp according to the exemplary embodiment.

With reference to FIG. 2, a cross-sectional view of an exemplary HID lamp 10 is shown. The lamp includes a discharge vessel or arc tube 12, which defines an interior chamber 14, and may be enclosed in shroud 36. The discharge vessel wall 16, may be fowled of a ceramic material, such as alumina, or other suitable light-transmissive material, such as quartz glass. An ionizable fill 18 is sealed in the interior chamber 14. Electrodes 20, 22, which may be formed from tungsten, are positioned at opposite ends of the discharge vessel so as to energize the fill when an electric current is applied thereto. The two electrodes 20 and 22 are typically fed with an alternating electric current, through base 38, via conductors 24, 26 (e.g., from a ballast, not shown). Tips 28, 30 of the electrodes 20, 22 are spaced by a distance, d, which defines an arc gap. When the lamp 10 is powered, indicating a flow of current to the lamp, a voltage difference is created across the two electrodes. This voltage difference causes an arc across the gap between the tips 28, 30 of the electrodes. The arc results in a plasma discharge in the region between the electrode tips 28, 30. Visible light is generated and passes out of chamber 14, through wall 16.

The ionizable fill 18, as stated above, includes an inert gas, free mercury (Hg), and a halide component that does not include thallium halide, specifically thallium iodide. The halide component includes a rare earth halide and may further include one or more of an alkali metal halide and an alkaline earth metal halide. In operation, the electrodes 20, 22 produce an arc between tips 28, 30 of the electrodes that ionizes the fill to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber. Further, when the lamp is operated at less than its nominal lamp power, or rated power, these parameters combine to affect significantly the color of the light emitted from the lamp. By removing thallium iodide from the halide dose, it is possible to positively affect lamp performance at lower than nominal lamp power, thus generating energy savings without loss of performance, and in some instances generating improved lamp performance. In the following description of the fill, the amounts of the components refer to the amounts initially sealed in the discharge vessel, i.e., before operation of the lamp, unless otherwise noted.

The buffer gas may be an inert gas, such as argon, xenon, krypton, or a combination thereof, and may be present in the fill at from about 2-20 micromoles per cubic centimeter ($\mu mol/cm^3$) of the interior chamber 14. The buffer gas may also function as a starting gas for generating light during the early stages of lamp operation. In one embodiment, suited to CMH lamps, the lamp is backfilled with Ar. In another embodiment, Xe or Ar with a small addition of Kr85 is used. The radioactive Kr85 provides ionization that assists in starting the lamp. The cold fill pressure may be about 60-300 Torr, although higher cold fill pressures are not excluded. In one embodiment, a cold fill pressure of at least about 240 Torr is used. Too high a pressure may compromise lamp start-up. Too low a pressure can lead to increased lumen depreciation over life of the lamp.

The mercury dose, referred to above sometimes as "free Hg", may be present at from about 2 to 35 $mg/cm^3$ of the arc tube volume. The mercury weight is adjusted to provide the desired arc tube operating voltage for drawing power from the selected ballast.

As has been stated, the halide dose of the lamp in accord herewith does not include thallium halide, i.e., does not include thallium as a component of the halide dose. As was noted above, it has been known to not include thallium halide as part of the dose materials. However, those lamps not including thallium halide have experienced a decrease in lamp efficacy, rendering the use of thallium halide desirable. It has now been unexpectedly realized, however, that thallium halide may be removed from the dose without having a deleterious effect on photometric lamp properties by carefully choosing the remaining dose constituents. As such, it has now been determined that a CMH lamp having the following dose components, when operated at less than nominal operating power, exhibits no undesirable color shift, no reduction in lumen maintenance, and good luminous efficacy. The dose includes $NaI_2$, $CaI_2$ or $SrI_2$, and $CeI_3$ or $LaI_a$, and does not include thallium halide. The dose may optionally contain Cs halide and/or In halide. A CMH lamp including the foregoing dose composition has been shown to exhibit good efficacy, excellent lumen maintenance and desired dimming without perceivable color shift.

The halide(s) in the halide component can each be selected from chlorides, bromides, iodides and combinations thereof. In one embodiment, the halides are all iodides. Iodides tend to provide longer lamp life, as corrosion of the arc tube and/or electrodes is lower with iodide components in the fill than with otherwise similar chloride or bromide components. The halide compounds will usually be present in stoichiometric relationships.

The rare earth halide of the halide component may include halides of at least lanthanum (La) and cerium (Ce), and may further include halides of praseodymium (Pr), europium (Eu), neodymium (Nd), samarium (Sm), and combinations thereof. The rare earth halide(s) of the fill can have the general form $REX_3$, where RE is selected from La and Ce, and optionally from Pr, Nd, Eu, and Sm, and X is selected from Cl, Br, and I, and combinations thereof, and may be present in the fill at any suitable concentration as known to those skilled in the art. Exemplary rare earth halides from this group are lanthanum halide and cerium halide. The fill will generally contain at least one of these halides, and may be present at a molar concentration of at least 1% of the total halides in the fill. In one embodiment, only rare earth halides from this limited group of rare earth halides are included. In particular, the fill is free of halides of the following rare earth elements: dysprosium, holmium, and thulium. While it is known to use the rare earth halides noted, it is our understanding that use of the same may result in decreased lumen maintenance when the lamp is operated at nominal or less than nominal lamp power. However, in light of the absence of TlI from the present dose, this disadvantage is overcome by the current lamp dose.

The alkali metal halide, where present, may be selected from Lithium (Li), sodium (Na), potassium (K), and cesium (Cs) halides, and combinations thereof. In one specific embodiment, the alkali metal halide includes sodium halide. The alkali metal halide(s) of the fill can have the general form AX, where A is selected from Li, Na, K, and Cs, and X is as defined above, and combinations thereof, and may be present in the fill at a suitable concentration as known to those skilled in the art. In one embodiment, the alkali metal halide includes sodium halide and cesium halide.

The alkaline earth metal halide, where present, may be selected from calcium (Ca), barium (Ba), and strontium (Sr) halides, and combinations thereof. The alkaline earth metal halide(s) of the fill can have the general form $MX_2$, where M is selected from Ca, Ba, and Sr, and X is as defined above, and combinations thereof. In one specific embodiment, the alkaline earth metal halide includes calcium halide. In another embodiment the alkaline earth metal halide includes strontium halide. The alkaline earth metal halide may be present in the fill at any suitable concentration as known to those skilled in the art. The alkaline earth metal halide component does not, however, include $MgX_2$. It is our understanding that use of the same may result in decreased lumen maintenance when the lamp is operated at nominal or less than nominal lamp power or may inhibit initial lamp lumen efficacy.

In one embodiment, the fill comprises:

68-72 mol % of alkali metal halide, 10-25 mol % of alkaline earth metal halide, and 2-6 mol % of rare earth halide, wherein the halide components are selected to be consistent with the foregoing disclosure.

In another embodiment, the fill comprises:

68-72 mol % of alkali metal halide, 10-25 mol % of alkaline earth metal halide, 2-6 mol % of rare earth halide, and at least 1.0 mol % cesium halide, wherein the halide components are selected to be consistent with the foregoing disclosure.

In still another embodiment, the fill comprises:

68-72 mol % of alkali metal halide, 10-25 mol % of alkaline earth metal halide, 2-6 mol % of rare earth halide, and at least 1.0 mol % indium halide, wherein the halide components are selected to be consistent with the foregoing disclosure.

All of the foregoing ranges, for not only dose composition but also color parameters, may be simultaneously satisfied in the present lamp design. Unexpectedly, this can be achieved without negatively impacting lamp reliability or lumen maintenance. Thus, for example, the exemplary lamp may exhibit a CCT, CRI and color point correlating to improved color quality, i.e., white light emission, and yet maintain lumen output and lamp life in accord with or better than known, desirable standards.

The following Table 1 sets forth exemplary halide lamp doses that achieve all of the performance parameters set forth herein, i.e., reduced energy usage without color shift away from white, good lumen maintenance, and excellent efficacy. Also included is a comparative dose composition.

TABLE 1

| Example | TOTAL ACTUAL MF | | | | | | | | |
|---|---|---|---|---|---|---|---|---|---|
| | NaI | CaI2 | CeI3 | TmI3 | LaI3 | SrI2 | CsI | TlI | InI |
| 1 | 0.708 | 0.244 | 0.035 | \ | \ | \ | 0.012 | \ | \ |
| 2 | 0.70 | 0.12 | 0.02 | \ | \ | 0.12 | 0.03 | \ | \ |
| 3 | 0.706 | 0.247 | 0.035 | \ | \ | \ | 0.012 | \ | \ |
| 4 | 0.70 | \ | 0.05 | \ | \ | 0.25 | \ | \ | \ |
| 5 | 0.70 | 0.24 | 0.05 | \ | \ | \ | \ | \ | 0.01 |
| 6 | 0.70 | 0.24 | 0.06 | \ | \ | \ | \ | \ | \ |
| Prior Art | 0.72 | 0.18 | \ | 0.06 | \ | \ | \ | 0.04 | \ |

Figure 3:
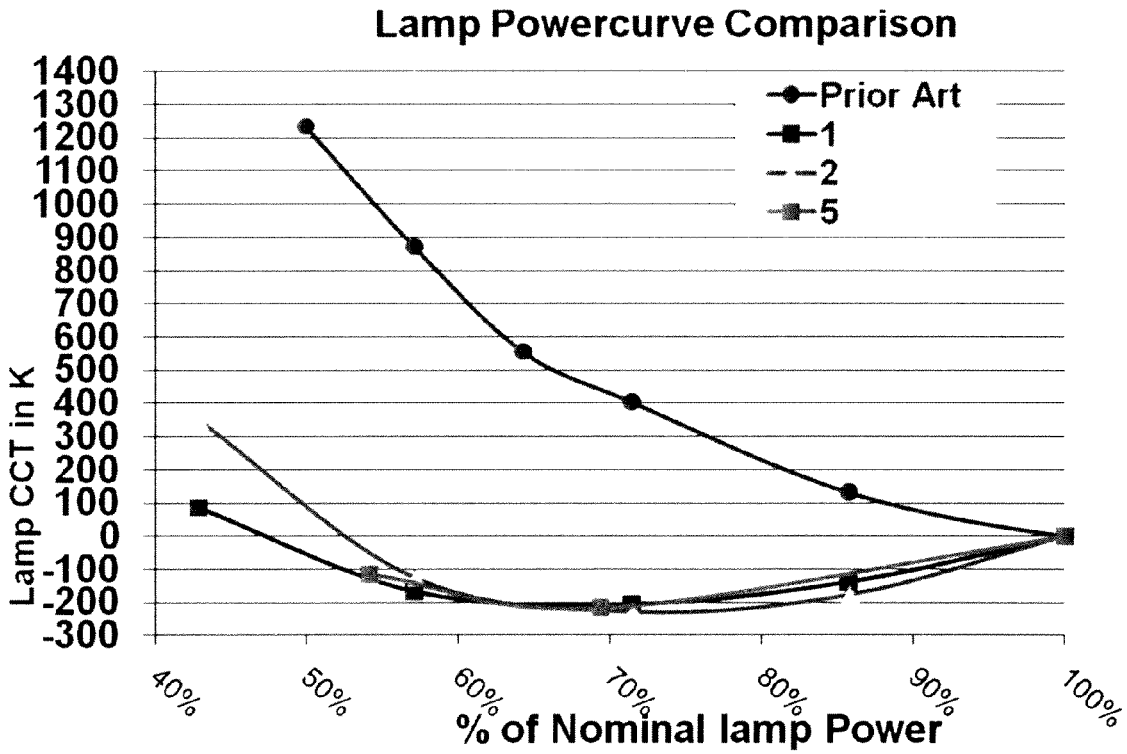
FIG. 3 is a graph showing the lamp CCT, in degrees Kelvin (° K), as a function of the percentage of nominal lamp power for lamps in accord with an embodiment of the invention as compared to a comparable, conventional lamp.

FIG. 3 provides a graph of the lamp CCT as a function of the % of Nominal Lamp Power. All lamps were rated for 70 W at 100% nominal power. As can be seen, all lamps exhibit a lamp CCT at 100% nominal power shown to be 0, which would correspond to a lamp temperature of 3000° K. Lamps 1, 2 and 5, corresponding to Table 1, Examples 1, 2 and 5, and in accord with at least one embodiment of the invention, generate a knee shaped pattern, showing a slight dip in CCT followed by a minimal rise in CCT. At about 43% nominal power all three lamps in accord with the invention are within 100° K of the lamp CCT at 100% nominal power, i.e., at about 3100° K. In contrast, the comparative Prior Art lamp, corresponding to the Prior Art lamp of Table 1, shows a consistent rise in CCT as the nominal lamp power is reduced below 100%, and at 50% nominal power show an increase in CCT of 1250° K to about 4250° K. This large increase in CCT correlates to a shift in lamp emission color toward green, which is undesirable for display and retail lighting, as well as other types of commercial lighting.

Figure 4:
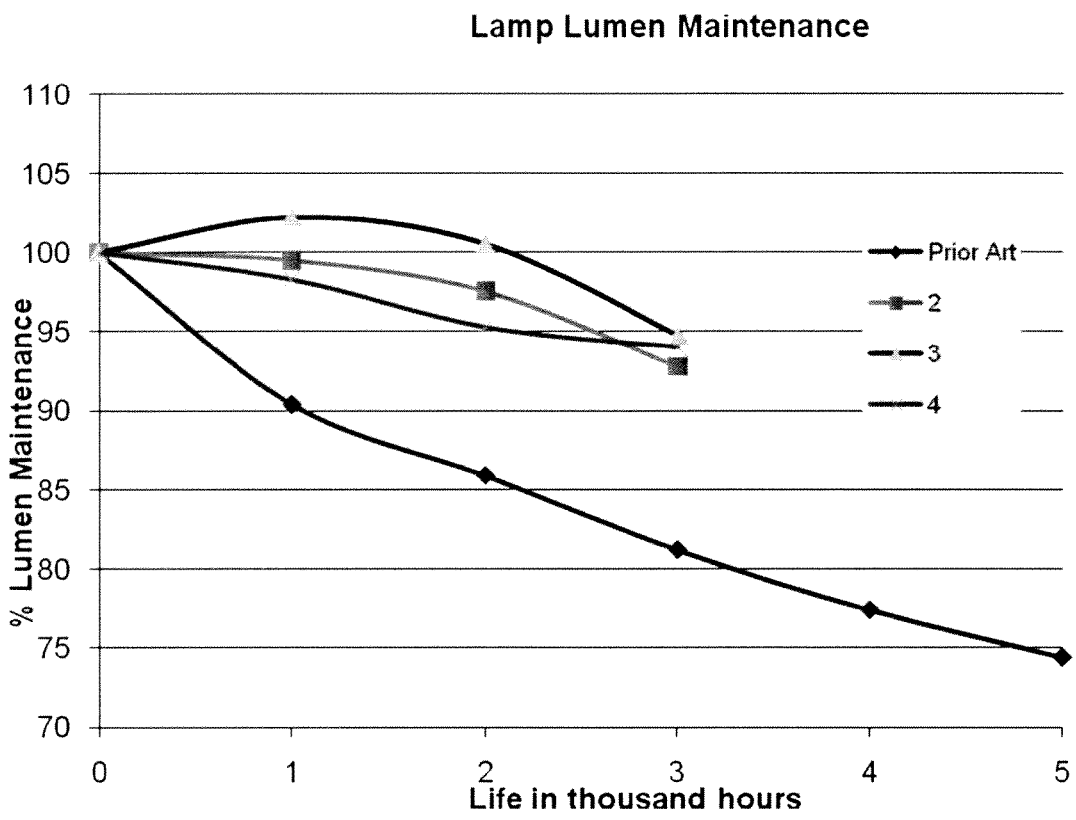
FIG. 4 is a graph showing % lumen maintenance as a function of lamp life (in thousands of hours) for lamps in accord with an embodiment of the invention as compared to a comparable, conventional lamp.

FIG. 4 provides a graph illustrating % Lumen Maintenance as a function of Lamp Life in thousands of hours. The dose compositions for the lamps are shown in Table 1 above. Table 2, below, provides performance data for lamps having the dose compositions as set forth in Table 1 with regard to the noted example, i.e., Example 1 dose from Table 1 corresponds to the performance data for Example 1 in Table 2. The data represents an average taken from a number of identical lamps, as noted in column 2 of Table 2.

TABLE 2

| Example | No. samples | VOLTS | WATTS | LUMENS | LPW | CCT | CRI | Lumen Maint .% of Initial 1000 hour | 2000 hour | 3000 hour |
|---|---|---|---|---|---|---|---|---|---|---|
| 2 | 5 | 95 | 72 | 6998 | 97 | 3564 | 86 | 100 | 98 | 93 |
| 3 | 5 | 91 | 72 | 6579 | 91 | 3232 | 83 | 102 | 101 | 95 |
| 4 | 5 | 94 | 72 | 6989 | 97 | 3666 | 84 | 98 | 95 | 94 |
| 5 | 6 | 92 | 72 | 6431 | 90 | 3005 | 85 | n/a | n/a | n/a |
| 6 | 6 | 87 | 72 | 6670 | 93 | 3167 | 82 | n/a | n/a | n/a |
| Prior Art | 12 | 92 | 72 | 6200 | 86 | 3000 | 82 | 90 | 86 | 81 |

With reference to the data set forth in Table 2 and FIG. 4, it is shown that the comparative Prior Art lamp, including TlI in the dose, has a lower lumen maintenance over the life of the lamp, i.e., after 3000 hours of operation, shown to be 81%, as compared to Examples lamp 2, 3 and 4, none of which include TlI in the dose, and which all exhibit lumen maintenance, over 3000 hours of operation, in excess of 91%, and as high as 95%.

The invention has been described with reference to the preferred embodiments. Obviously, modifications and alterations will occur to others upon reading and understanding the preceding detailed description. It is intended that the invention be construed as including all such modifications and alterations.

Having thus described the invention, it is now claimed:

1. A lamp comprising:

a discharge vessel;

electrodes operatively associated with the discharge vessel; and an ionizable fill sealed within the vessel, wherein the fill is free of halides of thallium but includes:

(a) an inert gas, (b) mercury, and (c) a halide component comprised of:

68-72 mol % sodium halide;

10-25 mol % calcium or strontium halide;

2-6 mol % of at least one of cerium or lanthanum halide; and 1-3 mol % cesium halide, wherein the lamp, when operated at 50% nominal lamp power, exhibits a CCT of within +/−250° K of the CCT of the lamp when operated at 100% nominal lamp power.

2. The lamp of claim 1, wherein the halide component further includes indium halide.

3. The lamp of claim 1, wherein the fill is free of holmium, thulium, dysprosium, scandium, and magnesium.

4. The lamp of claim 1, wherein the lamp emits white light.

5. The lamp of claim 1, wherein the halide component is an iodide.

6. The lamp of claim 1, wherein the halide component is selected from the group consisting of chlorides, bromides, iodides and combinations thereof.

7. The lamp of claim 1, wherein the sodium halide is sodium iodide.

8. The lamp of claim 1, wherein the fill comprises:

20-25 mol % of calcium or strontium halide; and 3-5 mol % of at least one of cerium or lanthanum halide.

9. The lamp of claim 1, wherein the fill further comprises:

1-3 mol % indium halide.

10. The lamp of claim 1, wherein the lamp exhibits a lumen maintenance of at least about 85% after 3000 hours operation at the nominal lamp power.

11. The lamp of claim 1, wherein the lamp exhibits a CRI of at least about 83 when operated at the nominal lamp power.

12. The lamp of claim 1, wherein the dose comprises an inert gas, Hg, NaI, $CaI_2$, $LaI_3$, and optionally one of InI and CsI.

13. The lamp of claim 1, wherein the dose comprises an inert gas, Hg, NaI, $SrI_2$, $LaI_3$, and optionally one of CsI and InI.

14. The lamp of claim 1, wherein the dose comprises an inert gas, Hg, NaI, $CaI_2$, and $CeI_3$, and optionally one of CsI and InI.

15. A method of forming a lamp, comprising:

providing a discharge vessel;

sealing an ionizing fill within the vessel, wherein the fill is free of halides of thallium but includes:

(a) an inert gas, (b) mercury, and (c) a further halide component comprised of:

72 mol % sodium halide;

10-25 mol % calcium or strontium halide;

2-6 mol % of at least one of cerium or lanthanum halide; and 1-3 mol % cesium halide; and positioning electrodes within the discharge vessel to energize the fill in response to a voltage applied thereto, wherein the lamp, when operated at less than 50% of its nominal lamp power, exhibits an MPCD of less than 6.

16. The method of claim 15, wherein the lamp CCT increases by no more than 250° K when operated at less than 50% of its nominal lamp power.

17. The method of claim 15, wherein the lamp emits white light when operated at less than 50% of its nominal power.

* * * * *